US005458425A

United States Patent [19]

Torok

[11] Patent Number: 5,458,425

[45] Date of Patent: Oct. 17, 1995

[54] KEYBOARD FOR TOUCH TYPE EDITING

[76] Inventor: Ernest J. Torok, 5100 31st Ave. South, Minneapolis, Minn. 55417

[21] Appl. No.: 790,489

[22] Filed: Nov. 12, 1991

Related U.S. Application Data

[63] Continuation of Ser. No. 561,166, Aug. 1, 1990, abandoned.

[51] Int. Cl.[6] ..... B41J 5/10

[52] U.S. Cl. ..... 400/489; 400/486

[58] Field of Search ..... 400/82, 472, 476, 400/486, 488, 489, 492; 340/711

[56] References Cited

U.S. PATENT DOCUMENTS

| | | | |
|---|---|---|---|
| 4,564,751 | 1/1986 | Alley et al. | 235/146 |
| 4,974,183 | 11/1990 | Miller | 400/486 |
| 5,143,462 | 9/1992 | Klauber | 400/486 |

OTHER PUBLICATIONS

"Byte" the small systems journal Apr. 1982 vol. 7, No. 4 A revolution in your pocket.

IBM Tech. Disc. Bulletin vol. 28, No. 6 Nov. 1985 "Programmable Function Keys".

*Primary Examiner*—Ren Yan

*Attorney, Agent, or Firm*—Haugen and Nikolai

[57] ABSTRACT

A keyboard for a word processor is disclosed that combines a Universal (qwerty) keyboard with touch type editing means. Editing functions are those that provide cursor movement (e.g. the arrow keys) or the delete or insert functions. Touch typing means are those that can be accessed rapidly without large arm movements and while at least one finger of each hand remains on a home key. Touch type editing can be provide most easily by adding keys accessed by the thumbs, the only digits underutilized in the Universal keyboard configuration. A preferred embodiment is a Universal keyboard with editing keys placed between the space bar of that Universal keyboard and the operator.

7 Claims, 6 Drawing Sheets

Figure 1: Prior Art

Figure 2: Prior Art

KEYBOARD FOR TOUCH TYPE EDITING

This is a continuation of application Ser. No. 07/561,166, filed on Aug. 1, 1990, now abandoned.

BACKGROUND OF THE INVENTION

1. Field of the Invention

This invention relates generally to conventional word processing keyboards, and more particularly to a modification allowing editing functions such as delete, right arrow, left arrow, down arrow, up arrow, page up, page down, home, end, and insert to be performed rapidly without substantial arm movement and while leaving at least one finger of each led on the home keys, i.e. by touch typing.

2. Definitions

As an aid to a better understanding of the invention, the following definitions apply throughout the specification and claims.

"Editing means" is defined as a memos of (a) moving the cursor backwards, forwards, up or down without erasing, or (b) Erasing characters ahead of the cursor (i.e. the delete key in I.B.M. clones) or (c) toggling between the insert and overwrite mode (i.e. the insert key in I.B.M. clones).

The "home keys" are defined with reference to the familiar Universal keyboard (see below) as the "a", "s", "d", and "f" keys for the left hand and the "j", "k", "l", and ";" keys for the right hand. This should not be confused with the "Home key" (note capital H), which is an editing key (see 46 in FIG. 4).

"Programmable Key" is defined as either one of the "Function" keys (i.e. "F1" through "F12" identified as 10 in FIG. 2; these can be programmed so when one of those keys is touched, a string of keystrokes is performed).

"Touch typing" is defined as the technique of rapid typing without substantial arm movement mad without looking at the keyboard; each finger is assigned an exclusive group of keys, and the positioning of the hand is effected by keeping at least one finger of each hand on one of the home keys.

"Touch typing key" is defined as a key that can be accessed without substantial arm movement and without looking at the keyboard, while leaving at least one finger of each hand on a home key, and is located close enough to a home key so that the finger that is assigned to that key can alternate between that key and the home key nearly as fast as that finger can repeatedly type the home key.

"Semi-touch typing key" is defined as a key that can be found without looking at the keyboard, but is far enough from the home keys and awkwardly enough placed so that the finger to which it is assigned cannot alternate between it and the corresponding home key substantially faster than half the speed that that finger can repeatedly type the home key. Most people don't type the semi-touch typing keys without looking. Examples are the "Control" keys, the "Alt" keys and the "Function" keys illustrated in FIG. 2. For the purpose of this definition, the space bar is considered the home key of the thumb.

"Typewriter keys" are defined as those keys usually found on an ordinary typewriter keyboard, and in particular, those shown in FIG. 1.

"Word processing keyboard" is defined as a computer keyboard having alpha-numeric keys for entry of words, characters or control signals into the computer system.

"Universal keyboard" is defined as the configuration of the alpha/numeric keys that typists are all familiar with; in English-speaking countries, it is the five row staggered configuration shown in FIG. 1, with "1 2 3 4 5 6 7 8 9 0" in the first row, "q w e r t y u i o p" in the second row, "a s d f g h j k l ;" in the third row, "z x c v b n m , ." in the fourth row; and the space bar in the fifth row.

DISCUSSION OF THE PRIOR ART

Very early in the history of the typewriter, people recognized that touch typing was very important. For example, von Kunowski in U.S. Pat. No. 556,422, which issued in 1896, remarked that "typewriting machines commonly used have the disadvantage that . . . the lower arm has to be shifted, because the keys can- not be reached by the sole movement of the fingers while the arm is at rest". He further stated that his "improved keyboard can therefore be used even by blind persons". Touch typing is important because it is much faster than the hunt and peck technique. For example, the inventor, can copy a paragraph from a book at 50.2 words per minute by touch typing; and at only 12.0 words per minute by two finger hunt and peck. An expert typist can typically touch type more than 100 words per minute.

Until the development of the computer and the word processor, editing functions were not possible on a typewriter. If one wanted to substitute a long word for a short word, or wanted to insert a sentence in the middle of the text, one had to retype the whole document. Consequently, keyboard patents concentrated on keyboard refinements tint made copying text by touch typing easier and faster.

A large portion of the prior art keyboard patents discussed below were a futile attempt to replace the familiar Universal keyboard. These attempts were doomed to failure because the Universal keyboard was (and is) too timely entrenched; anyone who purchased and trained on a typewriter with a non-standard key configuration would find himself unable to me any other typewriter, including those at his place of employment.

Lack of acceptance of the non-standard key configurations occurs even though most of those keyboard configurations may be faster and more efficient than the Universal keyboard. The above mentioned Kunowski patent was for a non-standard keyboard and stated that "keys for the letters mostly used are placed in those positions on which the point of the strongest and most agile fingers rest or which they can easily reach. The vowels and diphthongs are apportioned to the thumbs . . . " Other non standard keyboard patents are listed below:

U.S. Pat. No. 1,200,439 by Kemble (issued 1916) in which the shift key and the space bar are operated by the palms of the hands, U.S. Pat. No. 1,336,151 by O'Connor (1920) in which five characters are controlled by each key and the complicated shift keys operated by the feet with heel and toe attachments, U.S. Pat. No. 1,652,464 by Tyberg (1927) in which a Universal keyboard is split apart in the center and in which "shift", "shift lock", "return", "space", "reverse", "release", "paper", and "feed" keys are controlled by the thumbs, U.S. Pat. No. 1,678,334 by fischer (1928) in which "space" keys and "shift" keys and two character keys, all in a line, are operated by the thumbs, U.S. Pat. No. 2,040,248 by Dvorak and Dealey (1936), perhaps the most famous of all the alterative keyboards, is based on extensive research on the frequency of occurrence of letter combinations, or digraphs, U.S. Pat. No. 2,369,807 by Solon (1945), a Universal keyboard with curved surface and in which spacers, shift keys, backspacer, margin release and shift locks operated by the thumbs, U.S. Pat. No. 3,929,216 and U.S. Pat. No. 3,945,482 (1975 and 1976) by Einbinder in which the two halves of a non-standard keyboard are separated for comfort, and the thumbs are expected to strike various character keys as well as the carriage return, tab, backspace, shift, shift lock, and margin release, U.S. Pat. No. 4,081,068 by Zapp (1978) discloses an arrangement in which a keyboard is actuatable with the fingers of just one hand, U.S. Pat. No. 4,244,659 by Malt (1981) shows a configuration in which the two halves of a non standard keyboard are separated, the key rows curved for comfort, and the thumbs activate the "e", "period", space bar, and carriage return, U.S. Pat. No. 4,265,557 by Runge (1981) discloses a keyboard in which each finger is surrounded by four keys, one activated by raising the finger, one by pushing the finger away, one by pushing down, and one by pulling back, U.S. Pat. No. 4,332,493 by Einbinder (1982) describes a non Universal keyboard designed to maximize the number of successive keystrokes by the same hand and minimize the number of successive keystrokes by the same finger, U.S. Pat. No. 4,467,321 by Volnak (1984) teaches a chordal keyboard (a chordal keyboard is one in which two or more keys ate pressed simultaneously as in playing a chord on a piano in order to create a single character,, the advantage is that no finger ever has to change to another key), U.S. Pat. No. 4,483,634 by Frey et at. (1984) teaches a keyboard with two outboard keyfields reachable by large lower arm movements (this is an undesirable, slow configuration), U.S. Pat. No. 4,655,621 by Holden (1987) describes another chordal keyboard, U.S. Pat. No. 4,775,255 by Langley (1988), discloses a chordal keyboard with keys having three positions, U.S. Pat. No. 4,824,268 by Diernisse (1989) teaches an ergonomic keyboard with a non-Universal (non qwerty) key arrangement in which the thumbs operatea plurality of keys including editing keys.

U.S. Pat. No. 4,849,732 by Dolenc (1989) describes a non Universal keyboard to be operated by only one hand and in which the control functions are operated by the thumb.

U.S. Pat. No. 4,917,516 by Retter (1990), a small keyboard shaped to fit a hand, with holes for fingers and thumb and with key switches on the sides and bottom of each hole, and with mouse means built in so that the whole keyboard can be moved to function as a mouse.

These examples of prior art illustrate three important points:

(a) Touch typing is universally accepted as the fastest typing method. All the above patents only disagree on the keyboard configuration that makes touch typing faster.

b) The Universal keyboard arrangement is so firmly entrenched that no other keyboard configuration can displace it. The above patents teach against this. However, as reflected by what is available in the marketplace, they have all been rejected by the consumer. No matter how efficient an alternative keyboard is, and most of the above patented keyboards are more efficient none has been commercially successful. This is because it is overwhelmingly important to be able to use keyboards in many places, including places of employment and those keyboards are of the Universal configuration only.

(c) The thumb is capable of manipulating a plurality of keys very efficiently, and it is a waste to limit the thumb to just the space bar. It is interesting to note that in music as well, the thumb was under utilized for centuries. Not until the time of J. S. Bach was the thumb used in keyboard playing. One of his sons, Carl Phillip Emanuel Bach, wrote a textbook entitled "Essay on the True Art of Playing Keyboard Instruments" (Eulenburg Books, London). In there he said:

"My deceased father told me that in his youth he used to hear great men who employed their thumbs only when large stretches made it necessary. Because he lived at a time when a gradual but striking change in musical taste was taking place, he was obliged to devise a far more comprehensive fingering and especially to enlarge the role of the thumbs and use them as nature intended; for, among their other good services, they must be employed chiefly in the difficult tonalities. Hereby, they rose from their romper uselessness to the rank of principal finger . . ." The surprising changes in keyboard use with word processors When word processors became available in the late 1970s, the way keyboards were used changed, the kind of people that used them changed, and (although people don't yet realize this) the criteria for an optimum keyboard configuration should have changed.

Until word processors were developed, editing keys were nonexistent. If a typist wanted to connect a mistake, she either had to use an eraser or retype the whole document. More recently, white ink applied either with a brush or a typewriter key replaced the eraser. Nevertheless, only the most trivial revisions could be carried out without retyping the whole document. Consequently, important documents were generally dictated or written in longhand, then typed (by a professional typist) in rough draft form, revised and edited, retyped (by a professional typist), and sometimes edited again and retyped again. Thus it was very important to have a secretary who could copy an edited document very fast and accurately.

All of this changed when personal computers became available. Even a person with rudimentary touch typing skills could type faster than he could write by hand, and corrections were easily made. Whole paragraphs could be transported to another place in a document. The choice of words could be changed easily.

It became common for engineers, managers, and other professionals to have their own personal computer at their desks. One large corporation, for example, made the policy that every professional would have a personal computer on his desk, and that no secretary would be assigned a computer. These people compose on a personal computer, editing as they go along. Documents are never retyped since alterations are so easy to make. There is no longer any need for a secretary who can copy an edited document very fast and make no mistakes; now the need is for the capability of fast and convenient altering and editing by the person actually writing the document.

The present word processor keyboards are all, without exception, designed for the old way of creating documents. No one heretofore ever suspected that the editing keystrokes would ever be a significant fraction of the total keystrokes. Therefor the editing keys were put off to the side of the keyboard, too far away for touch typing. The typist must take his eyes away from the monitor screen, look for the proper editing key, press it, and then look for his place on the monitor again. This is much slower than touch typing, and will slow the writer significantly if there is an appreciable amount of editing. Accordingly, tests were performed to measure the usage of the editing keys. It was extremely surprising to find that the editing keys am used so often; the total editing keystrokes generally total more than half the character keystrokes, and more than one third the total keystrokes. This surprising fact means that all the present word processing keyboards are improperly designed, and that a huge improvement in performance can be gained by extending touch typing to the editing keys.

An ending speed test

Most all are familiar with typing speed tests, in which a typist copies a document as rapidly as possible. The typing speed is calculated by counting the total number of keystrokes, dividing by five to find the total number of words, and dividing by the number of minutes used for typing. It is not believed that any corresponding speed test for editing has been published. Accordingly, the inventor devised an editing speed test in which the number of editing keystrokes is somewhat larger than the number of character keystrokes. The test corresponds to the performance of a very poor typist, who has to make a huge number of corrections. The test is reproduced below. The reader is encouraged to take the test on his own word processor to discover for himself how slow it is to do editing with the present non-touch system. The editing speed is scored like a normal typing test: take the total number of keystrokes (in this case 165), divide by 5 to get the equivalent number of words, and divide by the number of minutes. If the test is done correctly, the text will read at the end: "Now is the time for all good men to come to the aid of their party". In this test, the right arrow key is denoted by ">" and the left arrow key is denoted by "<". A carriage shift is denoted by "return", arrow up and down me denoted by "arrow-up" and "arrow-down" respectively. A space between words is denoted by "spacebar"; make no other spaces between characters.

This is the test:

N o w i<spacebar>s spacebar t i n e spacebar<<<delete m>>return f o t spacebar<<delete r a l l<<<spacebar>>>m e b spacebar<<n delete>t w o delete>spacebar c o m e<<<<<delete<<<<<<< spacebar arrow-up<t h e spacebar arrow-down>>>>>>>>return arrow-up>>>>>>>> g o o d spacebar>>> return delete>>>>>>> spacebar t o spacebar tge spacebar<<<h delete>return a o d<<i delete>spacebar o f spacebar t h e e spacebar pa r t u.<<y delete <<<<<backspace Although the inventor normally types 50 words per minute, he was able to score only 10.8 words per minute on this editing speed test. The fastest score to date is 13.6 words per minute (by a professional typist after a few practice runs).

Proportion of editing commands in normal writing

The above example is unrealistic in that there are more typographical errors in it than people generally make unless they are true beginners. However, people who are actually composing a new document make a surprisingly large percentage of editing keystrokes, not because of typographical errors, but became they change the wording around, substitute one phrase for another, insert a new sentence into existing text etc. The inventor was extremely surprised when he recorded the number of editing keystrokes during ris preparation of a document. The percentage of editing keystrokes to total keystrokes was 37.8%! This means that the total typing speed is determined mostly by the slow editing speed.

The way a good writer edits and revises as he writes is shown in the following excerpt from the notebook of one of the very best: Mark Twain. This page from his notebook is reproduced in his own handwriting in the book Mark Twain Himself; A Pictorial Biography produced by Milton Meltzer, Thomas Y. Crowell Company, 1960. this excerpt shows the creation of a maxim for Puddin'head Wilson. Evidently Mark Twain thought that a cuckoo clock was an annoying distraction. Of course, Mark Twain lived long before the invention of the word processor, and wrote with pen and ink; consequently, rather than delete rejected passages he crossed them out; rather than inserting words with a word processor he used the caret symbol mad wrote new words above the old text. Had he used a word processor instead to make the corrections, the text would look like this (where the word processor instructions are enclosed in square brackets):

"The man that invented the cuckoo clock is dead. It is old news but good. [Delete "dead". Insert "no more"] [Delete the whole second sentence]

As news, this is a little stale, but [Delete "stale"; Insert "old"] some news is better old than not at all. [Delete second sentence]

As news, this is a little old, for it happened 264 years ago, but it is not the newest news that is the best. [Insert "always" between "not" and "the"] [Delete "best"; insert "most interesting"] [Delete second sentence]

It is old news, but there is nothing else the matter with it. [Delete both first and second sentence]

I give up. I'm sorry he died. [in the original, this was written vertically across the above scratched out material]

It is more trouble to construct a maxim than it is to do right. [Delete "construct"; insert "make"]

If one types the above excerpt from Mark Twain's notebook, one will use 285 editing keystrokes and 445 alphanumeric keystrokes. The proportion of editing keystrokes is 39% of the total the care that Mark Twain took with his wording is one reason he became a great writer.

The proportion of editing keystrokes to total keystrokes used varies with the type of document and varies from person to person. The reader is encouraged to determine his own ratio as he composes and revises an original document. Simply record every editing keystroke for a page of typing. Then count the keystrokes on the finished document, add the editing keystrokes to find the total, and take the ratio of the editing keystrokes to the total. Various people have been kind enough to record their editing keystrokes during serious composition. Most score in the 30% range; the lowest score was 22%. On the other hand, when people do frivolous composition such as "stream of consciousness" writing or unimportant writing such as personal letters, the editing percentage may fall to two or three percent.

A high percentage of editing keystrokes also exists when the keyboard is used to write computer programs, which nowadays is essentially word processing. These results indicate that the present word processing keyboards are improperly designed for the way they are now used in serious work. A large increase in the speed of document composition can be obtained by putting the editing keys close enough to be reached without substantial arm movement and with at least one finger of each hand on the home keys, i.e. by touch typing. One can get an idea of the speed increase achievable with the keyboard of the present invention by considering the following example: Suppose a typist types a document and uses a total of 10,000 keystrokes (2000 words where a word is 5 keystrokes whether they are alphanumeric or editing). Suppose the ratio of editing keystrokes to total keystrokes is 30%, and that his editing speed is 10 words per minute, while his alphanumeric typing speed is 50 words per minute. He then spends 60 minutes performing editing and 28 minutes typing alphanumerics, for a total time of 86 minutes. His net speed is then 2000/86 or 23 words per minute. If he had a keyboard with touch editing, he could prepare his document in 46% of the time. This is a doubling of productivity, and a huge saving in time.

It is a huge saving in money as well. If a corporation's cost, including overhead, per engineer is $100,000 per year, and if those engineers spend 50% of their time creating reports, computer programs, and documentation (which unfortunately is not uncommon in a large corporation) then a doubling of word processing productivity represents a $50,000 saving per engineer. Even if the engineers only spend 10% of their time on computers, the savings per engineer is $10,000 per year.

OBJECTS OF THE INVENTION

Accordingly, the principal object of this invention is to provide an improved layout for a word processing keyboard that preserves the Universal configuration for the alphanumeric keys but in which editing means are likewise accessible by touch typing.

DESCRIPTION OF THE FIGURES

The foregoing features, objects and advantages of the invention will become apparent to those skilled in the art from the following description, especially when considered in conjunction with the accompanying drawings in which.

Reference Numerals in Drawings: (Like numerals in the several views refer to corresponding parts)

Figure 1:
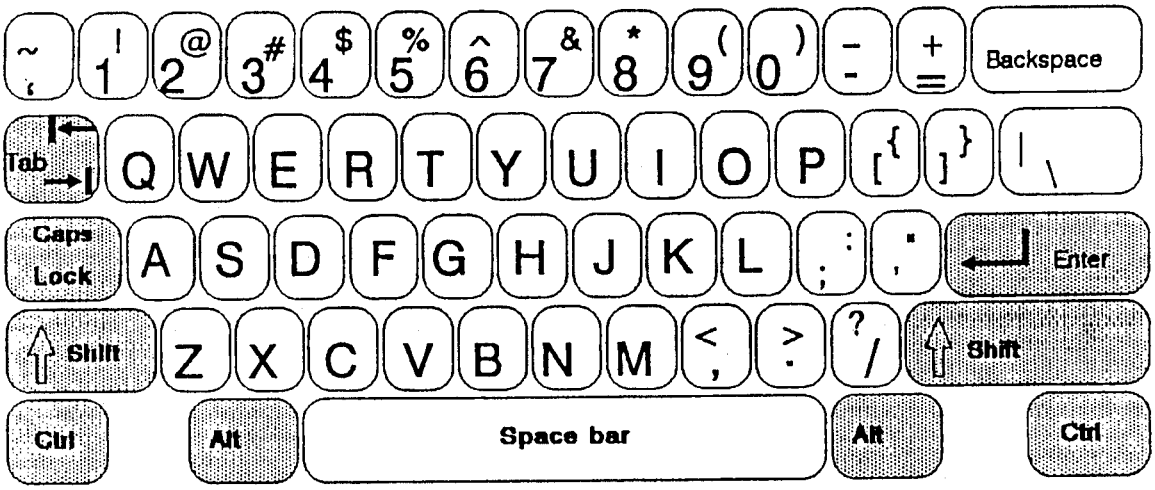
FIG. 1 shows the touch typing portion of a modem keyboard.

10 The function keys, F1 through F12
12 Special command keys: print screen, scroll lock, and pause/break
14 Editing keyboard keys: insert, home, page up, page down, delete, end, arrow left, arrow right, arrow up, arrow down.
16 The calculating machine keyboard keys
18 The escape key
20 Touch type arrow left key
22 Touch type arrow right key
24 Touch type arrow up key
26 Touch type arrow down key
28 Touch type delete key
30 Touch type page down key
31 Linkages for interconnecting supplemental edit keys to existing keys
32 Electronic supplementary keyboard -continued 34 Interface box that ORs the output of original and supplementary keyboards
36 Original keyboard without touch type editing
38 Computer
40 Cable that connected original keyboard to computer but now connects to interface box 34 instead
42 Cable connecting interface box to computer
44 Touch type "Insert" key
46 Touch type "Home" key
48 Touch type "Page Up" key
50 Touch type "End" key
52 Touch type "Escape" key
54 Cable connecting supplementary keyboard to interface box
55 Function key F9
57 Function key F10
59 Function key F11
61 Function key F12

DESCRIPTION OF THE PREFERRED EMBODIMENT

Several embodiments of the invention are herein described. Each is a combination of prior art and new features. The first two figures illustrate prior art.

FIG. 1 shows the "typewriter keys" of a typical modem prior art word processor. These keys are either touch typing keys or semi-touch typing keys (see definitions, page 1 and 2, infra). This key configuration is virtually identical to the keyboard of the typewriters that have been used in the United States throughout this century. The main exceptions are, of course, the control key and the alternate key. The alphanumeric keys are in the Universal configuration, which appears to be so firmly embedded as to be impossible to displace.

Figure 2:
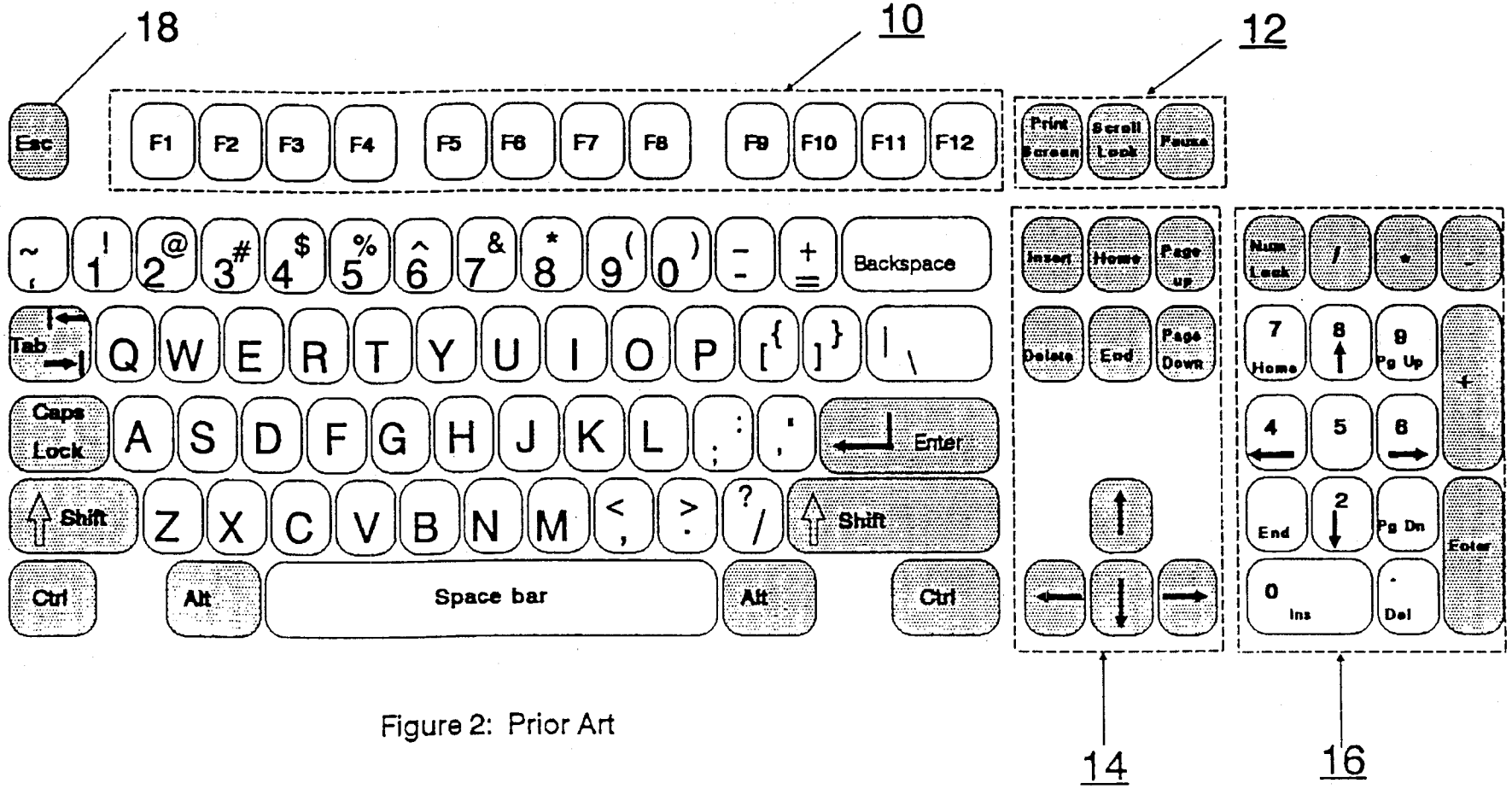
FIG. 2 shows a modem word processing keyboard such as provided with personal computers.

FIG. 2 shows the key configuration of a modem prior art word processing keyboard (for IBM compatible computers). This contains the keys of FIG. 1 plus certain others whose position is too far away from the home keys to permit touch typing:

Function keys 10. These are used for a programmed set of commands, such as saving the file, getting help, etc. With one touch of a function key, the operator causes a programmed set of instructions to be performed.

Special commands 12. These are the "Print Screen", the "Scroll Lock", and the "Pause/Break" keys.

Editing keyboard keys 14. These include the "Insert" key, the "Home" key, the Page Up" key, the "Delete" key, the "End" key, the "Page Down" key, the key to move the cursor left, the key to move the cursor fight, the key to move the cursor up, and the key to move the cursor down. The "Home" key moves the cursor to the left hand side of a group of words and should not be confused with what is called the home keys in touch typing, namely the "a", "s", "d", "f", "j", "k", "l", and ";" keys.

The calculating machine keyboard keys 16 . These keys duplicate the keyboard of a standard calculating machine. They also contain duplicate editing keys and a number lock key to let the operator select whether he wants to key numbers or editing functions.

The" Escape" key 18.

These keys are located too far away from the home keys to be reached without substantial arm movement and without looking at the keyboard. When the prior art keyboard configurations were created, it was thought that the use of these keys would be too infrequent to warrant their being made touch typing keys.

The present invention can be implemented in several embodiments, each of which has important commercial applications. They are described and discussed below.

Figure 3:
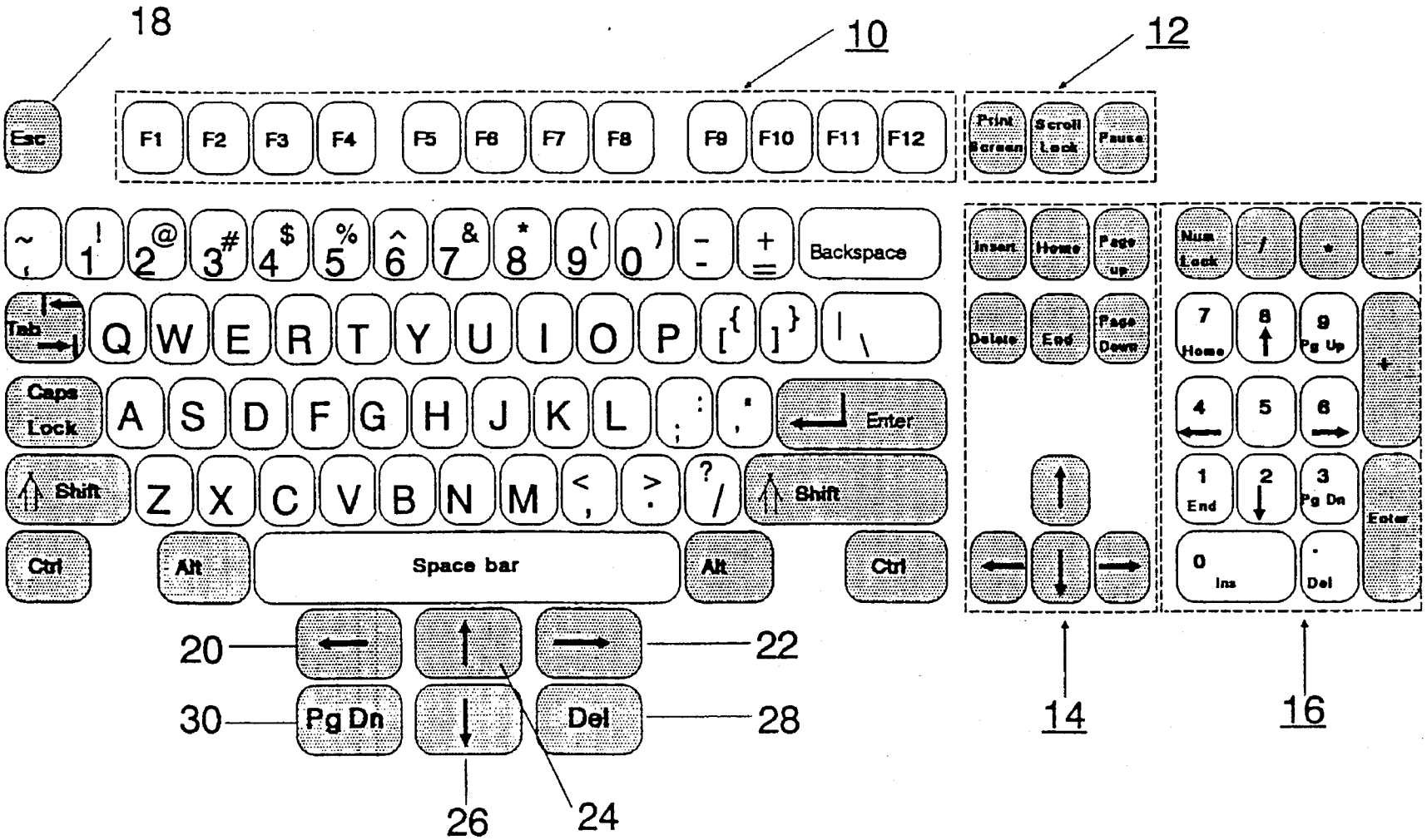
FIG. 3 shows a word processing keyboard with the most important keys for touch editing added, in accordance with the invention.

FIG. 3 shows a first embodiment where the prior art word processing keyboard of FIG. 2 is combined with six added touch typing keys. They include the "Arrow Left" key 20, which moves the cursor one space to the left, the "Arrow Right" key 22 which moves the cursor one space to the right, the "Arrow Up" key 24 which moves the cursor one line up, the "Arrow Down" key 26 which moves the cursor down one line, the "Delete" key 28, and the "Page Down" key 30. These keys am the most frequently used in editing. The "Arrow Right" and "Arrow Left" are the most frequent; the "Delete" key is next most frequent, and the "Arrow Up" and "Arrow Down" keys are the next after the "Delete" key. The "Page Down" key is the least frequently reed key of this group of six.

In accordance with the principle of the invention, these extra keys am placed so they can be activated by the thumbs in a touch typing manner, i.e. without substantial arm movement and with one or more fingers of each hand on the home keys. Such a keyboard was constructed and tested. With this set of supplementary keys, the inventor was able to perform the above editing speed test at a rate of 50 words per minute instead of 11.

Figure 4:
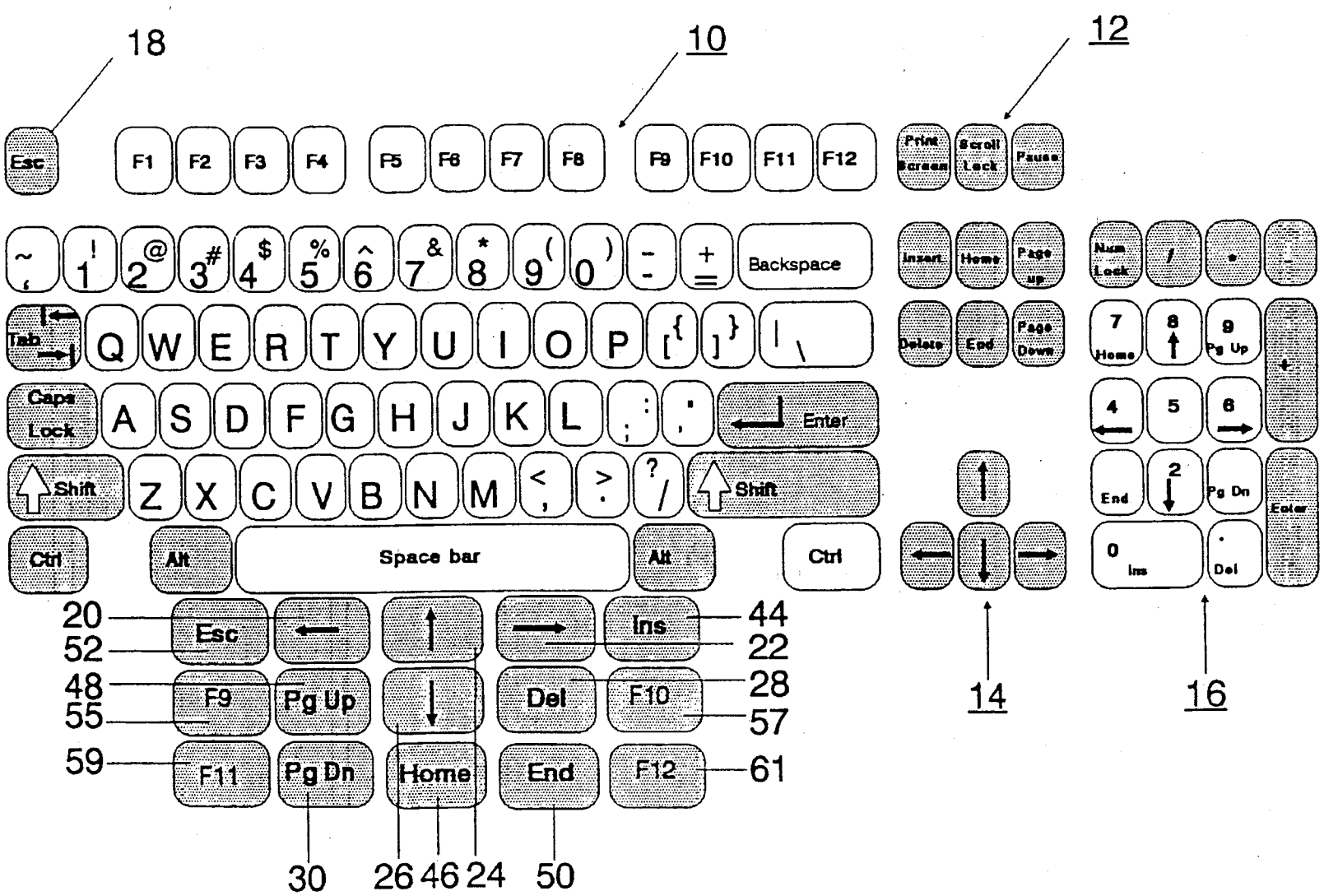
FIG. 4 shows a word processing keyboard in which all the editing keys are accessible by touch typing, i.e. while at least one finger of each hand remains on a home key.

FIG. 4 shows an alterative embodiment word processing keyboard having all keys required for touch type editing within reach while at least one finger of each hand rests on one of the home keys. The extra keys include the insert key 44, the Home key 46, the page up key 48, the end key 50, the escape key 52, the function key F9 55, the function key F10 57, ,the function key F11 59, and the function key F12 61. The function keys can be programmed to execute a series of commands with one keystroke; for example, it may be desirable to program F11 to move the cursor eight spaces to the left, and F12 to move the cursor eight spaces to the right.

Either embodiment can be implemented in the form of a complete keyboard in a single package or in the form of a mechanical or electronic keyboard supplement to be used in conjunction with the user's original keyboard, as discussed below.

There are three ways of implementing these embodiments:

(1) A complete keyboard can be constructed in the usual manner with the extra keys electrically connected to their counterpart on the regular keyboard of FIG. 2, or if the keys in the original position are deleted, the added keys are connected to the connected for the corresponding deleted keys on the decoder chip. For example, in FIG. 3, the six extra keys 20, 22, 24, 26, 28 and 30 are connected electrically to their counterparts in the editing keyboard 14 or, alternatively, to their counterparts in the calculating keyboard 16.

Figure 5:
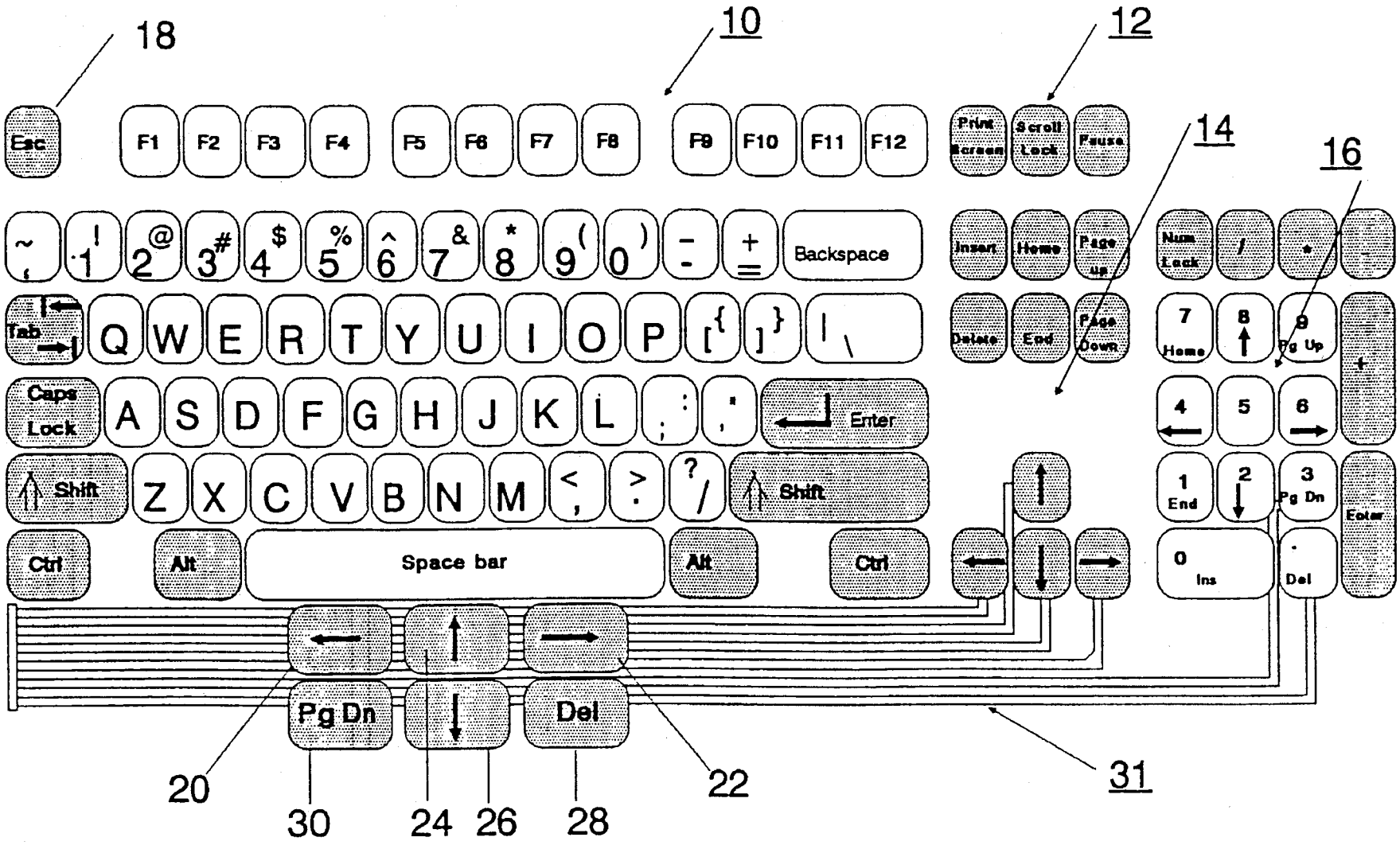
FIG. 5 shows a mechanical lever system to convert an existing word processing keyboard so that the most important editing keys ate accessible by touch typing in accordance with the invention.

(2) A mechanical supplementary key keyboard configured as an add-on device to be attached to an existing keyboard. Such a device is illustrated in FIG. 5. Each of the supplementary editing keys, 20, 22, 30 are redundant to the existing keys and are connected by mechanical links 31 to their counterparts in either the editing keyboard 14 or, alternatively, to their counterparts in the calculating keyboard 16 so that depression of one or the other of each pair results in the actuation of the edit function.

Figure 6:
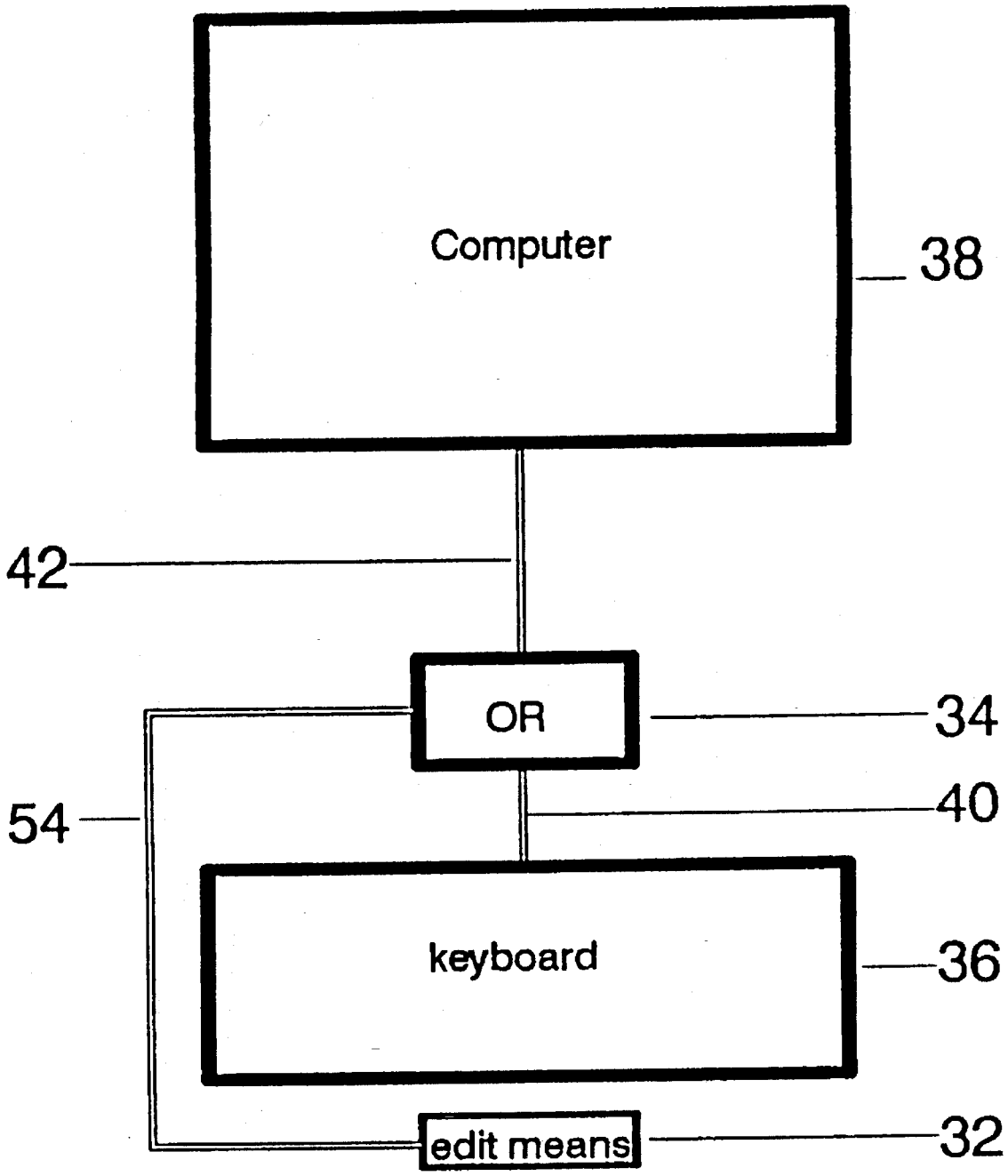
FIG. 6 shows an electronic keyboard supplement that converts an existing word processing keyboard to one with touch type editing.

(3) An electronic supplementary keyboard to be sold as an add-on device to be used in conjunction with the buyer's present keyboard. This is illustrated in FIG. 6. The original keyboard cable 40 from the original keyboard 36 has been disconnected from the computer 38 and plugged into a small interface box 34. The interface box 34 is connected to the computer 38 by a cable 42 that enters the same port vacated by the original keyboard cable 40. The electronic supplementary keyboard 32 is connected via output cable 54 to the interface box. The interface box supplies the two keyboards 36 and 32 with power from the computer 38 and ORs the outputs from the two keyboards 32 and 36 into the cable 42 leading to the computer 38. Thus a scan code pulse sequence from either keyboard enters the computer.

SUMMARY AND SCOPE

The combination of a Universal keyboard with touch type editing means is unique and novel. This combination produces an unusual and surprising result of great magnitude: A person composing at a word processor can, without learning a new alphanumeric key configuration, double his typing speed during composition.

This fact has a major economic impact; touch type editing can save a company tens of thousands of dollars per year per computer.

This combination was not previously discovered because of two universal misconceptions and two common misconceptions: (a) word processing keyboards are used like typewriters, (b) editing keys are seldom required if one is a good typist, (c) the way to increase typing speed is to replace the Universal keyboard, (d) the thumbs are awkward and fit only for the space bar.

The best way to provide touch editing is by utilizing the thumbs, the only digits underutilized in the Universal keyboard configuration. This can be done by placing the editing means (keys, mouse, trackball or joystick) between the spacebar and the operator and in reach of the thumbs when at least one finger of each hand remains on a home key.

There are more than three million six hundred thousand ways to arrange ten editing keys. If one also includes options of doubling certain keys so they can be accessed by either hand, or includes programmable keys, the number of permutations is astronomical. Accordingly, the invention is not to be limited by the given examples, but determined by the scope of the claims.

What is claimed is:

1. A word processing keyboard containing:

a: a set of typewriter keys arranged relative to one another in the standard Universal keyboard configuration with "1 2 3 4 5 6 7 8 9 0" in the first row, "q w e r t y u i o p" in the second row, "a s d f g h j k l ;" in the third row, "z x c v b n m , ." in the fourth row, and a one-piece space bar in the fifth row and without additional keys interposed, and b: editing means including at least one forward and one backward cursor control means so placed relative to said keys of said standard Universal keyboard that they can be activated by an operator's left or right thumb while at least one finger of each hand remains on a home key of said standard Universal keyboard, said editing means including at least one user programmable function key.

2. A word processing keyboard containing:

a: a set of typewriter keys arranged relative to one another in the standard Universal keyboard configuration with "1 2 3 4 5 6 7 8 9 0" in the first row, "q w e r t y u i o p" in the second row, "a s d f g h j k l ;" in the third row, "z x c v b n m , ." in the fourth row, and a one-piece space bar in the fifth row and without additional keys interposed, and b: editing means including a right-arrow key and a left-arrow key so placed relative to said keys of said standard Universal keyboard that they are located between the space bar and the body of said operator so as to be activated by said operator's left or right thumb while at least one finger of each hand remains on a home key of said standard Universal keyboard, said editing means including at least one user programmable function key.

3. The invention of claim 2 in which said editing means includes an up-arrow key.

4. The invention of claim 3 in which said editing means further includes a down-arrow key.

5. The invention of claim 4 in which said editing means further includes a delete key.

6. The invention of claim 5 in which said right-arrow key, said left-arrow key, said up-arrow key and said down-arrow key are placed off center to be controlled by the thumb of one hand, and in which said delete key is placed off center in order to be controlled by the thumb of the other hand.

7. A word processing keyboard comprising:

a: a set of typewriter keys arranged relative to one another in the standard Universal keyboard configuration with "1 2 3 4 5 6 7 8 9 0" in the first row, "q w e r t y u i o p" in the second row, "a s d f g h j k l ;" in the third row, "z x c v b n m , ." in the fourth row, and a one-piece space bar in the fifth row and without additional keys interposed, and b: a set of editing keys including a right-arrow key, a left-arrow key, an up-arrow key, a down-arrow key and a delete key but not a backspace/erase key, said set of editing keys so placed relative to said keys of said standard Universal keyboard that they are located between the space bar and the body of said operator so as to be activated by said operator's left or right thumb while at least one finger of each hand remains on a home key of said standard Universal keyboard, said editing means including at least one user programmable function key.

* * * * *